US010392752B2

(12) United States Patent
Wang et al.

(10) Patent No.: US 10,392,752 B2
(45) Date of Patent: Aug. 27, 2019

(54) PAPER COMPOSITION AND PROCESS FOR MAKING THE SAME

(71) Applicants: Dow Global Technologies LLC, Midland, MI (US); Rohm and Haas Company, Philadelphia, PA (US)

(72) Inventors: Tao Wang, Shanghai (CN); Weichao Gu, Shanghai (CN); Tao Wang, Highton (AU); Junyu Chen, Shanghai (CN); Haitao Du, Suzhou (CN); Rui Ma, Shanghai (CN); Yunfei Yan, Shanghai (CN)

(73) Assignees: DOW GLOBAL TECHNOLOGIES LLC, Midland, MI (US); ROHM AND HAAS COMPANY, Philadelphia, PA (US)

( * ) Notice: Subject to any disclaimer, the term of this patent is extended or adjusted under 35 U.S.C. 154(b) by 493 days.

(21) Appl. No.: 14/786,997

(22) PCT Filed: May 22, 2013

(86) PCT No.: PCT/CN2013/076038

§ 371 (c)(1),
(2) Date: Oct. 26, 2015

(87) PCT Pub. No.: WO2014/186953

PCT Pub. Date: Nov. 27, 2014

(65) Prior Publication Data

US 2016/0083908 A1 Mar. 24, 2016

(51) Int. Cl.

| | |
|---|---|
| ***D21H 17/00*** | (2006.01) |
| ***D21H 17/67*** | (2006.01) |
| ***D21H 23/04*** | (2006.01) |
| ***D21H 17/34*** | (2006.01) |
| ***D21H 17/69*** | (2006.01) |
| ***D21H 17/35*** | (2006.01) |

(52) U.S. Cl.

CPC ..... *D21H 17/74* (2013.01); *D21H 17/34* (2013.01); *D21H 17/35* (2013.01); *D21H 17/67* (2013.01); *D21H 17/675* (2013.01); *D21H 17/69* (2013.01); *D21H 23/04* (2013.01)

(58) Field of Classification Search

CPC ..... D21H 17/67; D21H 17/69; D21H 17/34; D21H 17/35; D21H 17/675; D21H 17/74; D21H 23/04; D21H 11/04; D21H 19/48

See application file for complete search history.

(56) References Cited

U.S. PATENT DOCUMENTS

| | | | | |
|---|---|---|---|---|
| 4,599,392 | A | 7/1986 | McKinney et al. | |
| 4,801,445 | A * | 1/1989 | Fukui | A61K 8/11 424/63 |
| 4,804,572 | A * | 2/1989 | Bodrogi | C09D 133/06 428/195.1 |
| 4,808,267 | A * | 2/1989 | Kerkhoff | D21H 17/14 162/13 |
| 4,963,192 | A * | 10/1990 | Dessauer | B41M 5/5245 106/486 |
| 4,988,781 | A | 1/1991 | McKinney et al. | |
| 5,126,187 | A * | 6/1992 | Punton | D21F 11/04 428/211.1 |
| 5,272,236 | A | 12/1993 | Lai et al. | |
| 5,278,272 | A | 1/1994 | Lai et al. | |
| 5,360,827 | A | 11/1994 | Toda et al. | |
| 5,504,172 | A | 4/1996 | Imuta et al. | |
| 5,595,828 | A * | 1/1997 | Weber | D21F 11/00 162/157.6 |
| 5,856,398 | A * | 1/1999 | Oizumi | D21H 19/38 524/406 |
| 5,938,437 | A | 8/1999 | DeVincenzo | |
| 6,525,157 | B2 | 2/2003 | Cozewith et al. | |
| 6,783,631 | B2 | 8/2004 | Schulz | |
| 6,960,635 | B2 | 11/2005 | Stevens et al. | |
| 7,253,216 | B2 | 8/2007 | Miyabayashi | |
| 7,993,757 | B2 * | 8/2011 | Gunzel | B41M 5/0035 428/537.5 |
| 8,785,531 | B2 | 7/2014 | Vansumeren et al. | |
| 2003/0170306 | A1 * | 9/2003 | Raether | C08F 293/00 424/484 |
| 2004/0209023 | A1 * | 10/2004 | Swoboda | B32B 29/06 428/34.2 |
| 2007/0240619 | A1 | 10/2007 | Munchow | |
| 2007/0249764 | A1 | 10/2007 | Shoaf et al. | |
| 2008/0319115 | A1 | 12/2008 | Munchow | |
| 2009/0311515 | A1 * | 12/2009 | Gunzel | B41M 5/0035 428/326 |
| 2010/0015459 | A1 * | 1/2010 | Tammi | D21H 19/42 428/537.5 |
| 2010/0063171 | A1 | 3/2010 | Roschmann et al. | |
| 2011/0319521 | A1 | 12/2011 | Lundgard et al. | |
| 2012/0321784 | A1 * | 12/2012 | Quintens | B41M 5/52 427/209 |

(Continued)

FOREIGN PATENT DOCUMENTS

| | | | |
|---|---|---|---|
| CA | 2363357 | A1 | 5/2002 |
| CA | 2566335 | A1 | 11/2005 |

(Continued)

OTHER PUBLICATIONS

Witucki, Gerald L.; A Silane Primer: Chemistry and Applicatinos of Alkoxy Silanes; A Journal of Coatings Technology Reprint; vol. 65; No. 822; pp. 57-60; (Jul. 1993).

*Primary Examiner* — Jose A Fortuna
(74) *Attorney, Agent, or Firm* — Cantor Colburn LLP

(57) ABSTRACT

A new paper composition comprising, a) from 15 wt. % to 70 wt. % a hiding composite comprising based on the total weight of the hiding composite, from 30 wt. % to 75 wt. % pigment particles and from 25 wt. % to 70 wt. % a thermoplastic polymer. The pigment particles are hydrophobically treated with the surface tension of the pigment particles being from 0.1 to 50 mN/m, and the surface tension difference between the pigment particles and the thermoplastic polymer being less than 40 mN/m; and b) from 30 wt. % to 85 wt. % a paper pulp. Process of making such a new paper composition.

13 Claims, No Drawings

(56) References Cited

U.S. PATENT DOCUMENTS

| | | | | |
|---|---|---|---|---|
| 2013/0210977 | A1 | 8/2013 | Yan et al. | |
| 2015/0330025 | A1* | 11/2015 | Luna Marroquin | D21H 17/11 162/158 |
| 2016/0083908 | A1* | 3/2016 | Wang | D21H 17/34 162/72 |
| 2016/0348318 | A1* | 12/2016 | Koenig | D21H 19/80 |
| 2018/0029330 | A1* | 2/2018 | Millares-Neyra | B32B 29/06 |

FOREIGN PATENT DOCUMENTS

| | | | | |
|---|---|---|---|---|
| CN | 1354304 | A | 6/2002 | |
| DE | 102013101899 | A1 * | 8/2014 | D21H 13/50 |
| EP | 0022633 | A2 | 1/1981 | |
| EP | 0404184 | A2 | 12/1990 | |
| EP | 0915108 | A1 | 5/1999 | |
| EP | 0959176 | A1 | 11/1999 | |
| JP | 2005097518 | A | 4/2005 | |
| JP | 2011046861 | A | 3/2011 | |
| WO | 00/01745 | A1 | 1/2000 | |
| WO | 0068304 | A1 | 11/2000 | |
| WO | 2007078536 | A1 | 7/2007 | |
| WO | 2007110367 | A1 | 10/2007 | |
| WO | 2009045731 | A2 | 4/2009 | |
| WO | 2013016398 | A1 | 1/2013 | |
| WO | WO-2014186953 | A1 * | 11/2014 | D21H 17/34 |

* cited by examiner

PAPER COMPOSITION AND PROCESS FOR MAKING THE SAME

FIELD OF THE INVENTION

The present invention relates to a paper composition with improved light scattering efficiency and a process for making the same.

INTRODUCTION

Compositions comprising pigments are widely used in architectural, automotive, and industrial applications. Pigments are mixed with a dispersant in water so that pigment agglomerates are wetted and dispersed into smaller pigment particles, i.e., pigment grind. Mechanical shear is usually employed to break pigment agglomerates into separated individual pigment particles and the separated individual pigment particles are in turn stabilized by a dispersant to maximize the light scattering ability, that is, opacity, of pigments. In high pigment-content compositions, pigment particles tend to easily re-agglomerate and their light scattering efficiency decreases. To compensate for re-agglomeration, even higher pigment loading would be required to get a satisfactory light scattering efficiency.

Decoration paper compositions require around 30 wt. % to 50 wt. % of pigment loading. The pigment loading level during the fabrication process is even higher. Re-agglomeration of pigments in decoration paper compositions significantly decreases the light scattering efficiency of pigments, and the composition will require more pigments to get a satisfactory light scattering efficiency.

It is therefore desirable to provide a high-pigment content paper composition less impacted by pigment re-agglomeration. The paper composition of the present invention provides significantly higher light scattering efficiency than currently commercially available paper compositions.

SUMMARY OF THE INVENTION

The present invention provides a paper composition comprising, based on the total weight of the paper composition, a) from 15 wt. % to 70 wt. % a hiding composite comprising based on the total weight of the hiding composite, from 30 wt. % to 75 wt. % pigment particles and from 25 wt. % to 70 wt. % a thermoplastic polymer, wherein the pigment particles are hydrophobically treated, the surface tension of the pigment particles is from 0.1 to 50 mN/m, and the surface tension difference between the pigment particles and the thermoplastic polymer is less than 40 mN/m; and b) from 30 wt. % to 85 wt. % a paper pulp.

The present invention further provides a process of preparing a paper composition comprising: a) preparing a hiding composite by i) pre-mixing, based on the total weight of a hiding composite, from 30 wt. % to 75 wt. % of pigment particles; and from 25 wt. % to 70 wt. % of a thermoplastic polymer to form a pre-mixture; ii) melt-kneading the pre-mixture with, based on the total weight of the hiding composite, from 1 wt. % to 50 wt. % of a first stabilizing agent; and from 1 wt. % to 10 wt. % of a low pH stable second stabilizing agent; wherein the pigment particles are hydrophobically treated, the surface tension of the pigment particles is from 0.1 to 50 mN/m, and the surface tension difference between the pigment particles and the thermoplastic polymer is less than 40 mN/m; and b) mixing the hiding composite with a paper pulp, and water; wherein the hiding composite is from 15 wt. % to 70 wt. %, and the paper pulp is from 30 wt. % to 85 wt. % based on the total weight of the paper composition.

In a preferred embodiment, the surface tension of the pigment particles is from 0.5 to 40 mN/m and the surface tension difference between the pigment particles and the thermoplastic polymer is less than 35 mN/m.

In some preferred embodiments, the pigment particles are selected from barium sulfate, lithopone, zinc phosphate, $TiO_2$, ZnO, or the mixture thereof.

In another embodiment, the thermoplastic polymer is selected from homopolymers or copolymers of an alpha-olefin, polyolefin, styrene, polyvinyl, polyester, polycarbonate, vinyl ester, resin, or the mixture thereof.

DETAILED DESCRIPTION OF THE INVENTION

The following test method abbreviations and identifiers apply herein: ASTM refers to ASTM International; GB refers Guo Biao, that is, China's national standard.

As used herein, the term "Tg" shall mean glass transition temperature measured by differential scanning calorimetry (DSC) using a heating rate of 20° C./minute and taking the inflection point in the thermogram as the Tg value. The term "calculated Tg" refers to the Tg of polymers determined via the Fox equation (T. G. Fox, Bull. Am. Physics Soc., Volume 1, Issue No. 3, page 123(1956)). The Tgs of homopolymers may be found, for example, in "Polymer Handbook", edited by J. Brandrup and E. H. Immergut, Interscience Publishers.

In a preferred embodiment of the present invention, one or more hydrophobically treated pigment particles, one or more thermoplastic polymers, one or more first dispersants, and one or more second dispersants are melt-kneaded in an extruder along with water and a neutralizing agent, such as ammonia, potassium hydroxide, or a combination of the two to form a stable dispersion containing uniform pigment-polymer composites.

Any melt-kneading methods known in the art may be used. In some embodiments, a kneader, or a BANBURY® mixer with a single-screw extruder or a multi-screw extruder, for example, a twin-screw extruder, is used. The hiding composite dispersions (hereinafter also refer to as "dispersion") of the present invention may be made with any process known in the art, for example, by use of an extruder or, in certain embodiments, a twin-screw extruder that is coupled to a back pressure regulator, a melt pump, or a gear pump. Exemplary embodiments also provide a base reservoir and an initial water reservoir, each of which including a pump. Desired amounts of base and initial water are provided from the base reservoir and the initial water reservoir, respectively. Any suitable pump may be used. In some embodiments, a pump that provides a flow of about 100 cc/min at a pressure of 50 bar is used to provide the base and the initial water to the extruder. In other embodiments, a liquid injection pump provides a flow of 150 cc/min at 40 bar or 200 cc/min at 35 bar. In some embodiments, the base and initial water are preheated in a pre-heater.

The processing temperature to form the dispersion varies from room temperature to 200° C. depending on the type of thermoplastic polymer or dispersants employed. In order to meet the decoration paper fabrication process and base paper recycling requirement, the melt temperature of the thermoplastic polymer is preferably above 100° C.

The hydrophobically treated pigment particles are in an amount of usage of from 30% to 75%, preferably from 40% to 70%, more preferably from 45% to 60%, in solid content by weight based on the total weight of the hiding composite.

"Hydrophobically treated pigment particle" means a pigment, by treatment, having a hydrophobic surface with its surface tension being from 0.1 to 50 mN/m, preferably from 0.5 to 40 mN/m, and more preferably from 5 to 35 mN/m.

The pigment particles are inorganic pigment particles and/or extenders.

"Inorganic pigment particle" refers to a particulate inorganic material which is capable of materially contributing to the opacity (i.e., hiding capability) of a composition. Such materials typically have a refractive index of greater than 1.8, and include titanium dioxide ($TiO_2$), zinc oxide, zinc sulfide, barium sulfate, barium carbonate, and lithopone. Titanium dioxide ($TiO_2$) is preferred.

The term "extender" refers to a particulate inorganic material having a refractive index of less than or equal to 1.8 and greater than 1.3, and including, for example, calcium carbonate, clay, calcium sulfate, aluminosilicates, silicates, zeolites, mica, diatomaceous earth, $Al_2O_3$, zinc phosphate, solid or hollow glass, and ceramic beads. Solid or hollow polymeric particles having a Tg of greater than 60° C. are classified as extenders herein. The details of such polymeric particles are described in EP22633, EP915108, EP959176, EP404184, U.S. Pat. No. 5,360,827, WO 00/68304, and US20100063171. The polymeric particles have a particle size of from 1 to 50 microns, preferably from 5 to 20 microns.

Preferably, the pigment particles are selected from the group consisting of barium sulfate, lithopone, zinc phosphate, calcium carbonate, $TiO_2$, ZnO, $SiO_2$, $Al_2O_3$, and the mixture thereof. More preferably, the pigment particle is $TiO_2$.

Examples of commercially available hydrophobically treated pigments include compound grades $TiO_2$, for example TI-PURE™ R-104 and TI-PURE R-105 $TiO_2$ commercially available from E. I. du Pont de Nemours and Company ("DuPont"). The processes of hydrophobical treatments to pigment particles are disclosed in many publications such as Witucki in "A Silane Primer: Chemistry and Applications of Alkoxy Silanes," Journal of Coatings Technology 65: 822 pages 57-60 (July 1993); and U.S. Pat. No. 4,801,445. All these processes may be used in the present invention.

In the present invention, the thermoplastic polymer is in an amount of usage of from 25% to 70%, preferably from 30% to 60%, more preferably from 40% to 55%, in solid content by weight based on the total weight of the hiding composite.

Examples of the thermoplastic polymer include homopolymers and copolymers (including elastomers) of an alpha-olefin such as ethylene, propylene, 1-butene, 3-methyl-1-butene, 4-methyl-1-pentene, 3-methyl-1-pentene, 1-heptene, 1-hexene, 1-octene, 1-decene, and 1-dodecene, as typically represented by polyethylene, polypropylene, poly-1-butene, poly-3-methyl-1-butene, poly-3-methyl-1-pentene, poly-4-methyl-1-pentene, ethylene-propylene copolymer, ethylene-1-butene copolymer, and propylene-1-butene copolymer; copolymers (including elastomers) of an alpha-olefin with a conjugated or non-conjugated diene, as typically represented by ethylene-butadiene copolymer and ethylene-ethylidene norbornene copolymer; and polyolefins (including elastomers) such as copolymers of two or more alpha-olefins with a conjugated or non-conjugated diene, as typically represented by ethylene-propylene-butadiene copolymer, ethylene-propylene-dicyclopentadiene copolymer, ethylene-propylene-1,5-hexadiene copolymer, and ethylene-propylene-ethylidene norbornene copolymer; ethylene-vinyl compound copolymers such as ethylene-vinyl acetate copolymer, ethylene-vinyl alcohol copolymer, ethylene-vinyl chloride copolymer, ethylene acrylic acid or ethylene-(meth) acrylic acid copolymers, and ethylene-(meth)acrylate copolymer; styrenic copolymers (including elastomers) such as polystyrene, ABS, acrylonitrile-styrene copolymer, α-methylstyrene-styrene copolymer, styrene vinyl alcohol, styrene acrylates such as styrene methylacrylate, styrene butyl acrylate, styrene butyl methacrylate, and styrene butadienes and crosslinked styrene polymers; and styrene block copolymers (including elastomers) such as styrene-butadiene copolymer and hydrate thereof, and styrene-isoprene-styrene triblock copolymer; polyvinyl compounds such as polyvinyl chloride, polyvinylidene chloride, vinyl chloride-vinylidene chloride copolymer, polymethyl acrylate, and polymethyl methacrylate; polyamides such as nylon 6, nylon 6,6, and nylon 12; thermoplastic polyesters such as polyethylene terephthalate and polybutylene terephthalate; polycarbonate, polyphenylene oxide, and the like; and glassy hydrocarbon-based resins, including poly-dicyclopentadiene polymers and related polymers (copolymers, terpolymers); saturated mono-olefins such as vinyl acetate, vinyl propionate, vinyl versatate, and vinyl butyrate and the like; vinyl esters such as esters of monocarboxylic acids, including methyl acrylate, ethyl acrylate, n-butyl acrylate, isobutyl acrylate, 2-ethylhexyl acrylate, dodecyl acrylate, n-octyl acrylate, phenyl acrylate, methyl methacrylate, ethyl methacrylate, and butyl methacrylate and the like; acrylonitrile, methacrylonitrile, acrylamide, mixtures thereof; resins produced by ring opening metathesis and cross metathesis polymerization and the like. These resins may be used either alone or in combinations of two or more.

Examples of suitable (meth)acrylates include methyl acrylate, ethyl acrylate, butyl acrylate, hexyl acrylate, 2-ethylhexyl acrylate, octyl acrylate and isooctyl acrylate, n-decyl acrylate, isodecyl acrylate, tert-butyl acrylate, methyl methacrylate, butyl methacrylate, hexyl methacrylate, isobutyl methacrylate, isopropyl methacrylate as well as 2-hydroxyethyl acrylate and acrylamide. The preferred (meth)acrylates are methyl acrylate, ethyl acrylate, butyl acrylate, 2-ethylhexyl acrylate, octyl acrylate, isooctyl acrylate, methyl methacrylate and butyl methacrylate. Other suitable (meth) acrylates that can be polymerized from monomers include lower alkyl acrylates and methacrylates including acrylic and methacrylic ester monomers: methyl acrylate, ethyl acrylate, n-butyl acrylate, t-butyl acrylate, 2-ethylhexyl acrylate, decyl acrylate, isobornyl acrylate, methyl methacrylate, ethyl methacrylate, n-propyl methacrylate, isopropyl methacrylate, n-butyl methacrylate, isobutyl methacrylate, sec-butyl methacrylate, cyclohexyl methacrylate, isodecyl methacrylate, isobornyl methacrylate, t-butylaminoethyl methacrylate, stearyl methacrylate, glycidyl methacrylate, dicyclopentenyl methacrylate, phenyl methacrylate.

In a preferred embodiment, the thermoplastic polymer comprises a polyolefin selected from the group consisting of ethylene-alpha olefin copolymers, and propylene-alpha olefin copolymers. In particular, the thermoplastic polymer comprises one or more non-polar polyolefins.

In another preferred embodiment, polyolefins such as polypropylene, polyethylene, copolymers thereof, and blends thereof, as well as ethylene-propylene-diene terpolymers, may be used. In some embodiments, preferred olefinic polymers include homogeneous polymers, as described in U.S. Pat. No. 3,645,992 issued to Elston; high density polyethylene (HDPE), as described in U.S. Pat. No. 4,076, 698 issued to Anderson; heterogeneously branched linear low density polyethylene (LLDPE); heterogeneously branched ultra low linear density polyethylene (ULDPE); homogeneously branched, linear ethylene/alpha-olefin copolymers; homogeneously branched, substantially linear ethylene/alpha-olefin polymers, which can be prepared, for example, by processes disclosed in U.S. Pat. Nos. 5,272,236 and 5,278,272, and high pressure, free radical polymerized ethylene polymers and copolymers such as low density polyethylene (LDPE) or ethylene vinyl acetate polymers (EVA).

In one embodiment, the thermoplastic polymer is a propylene-based copolymer or interpolymer. In some particular embodiments, the propylene/ethylene copolymer or interpolymer is characterized as having substantially isotactic propylene sequences. The term "substantially isotactic propylene sequences" and similar terms mean that the sequences have an isotactic triad (mm) measured by $^{13}C$ NMR of greater than about 0.85, preferably greater than about 0.90, more preferably greater than about 0.92 and most preferably greater than about 0.93. Isotactic triads are well-known in the art and are described in, for example, U.S. Pat. No. 5,504,172 and WO 00/01745, which refer to the isotactic sequence in terms of a triad unit in the copolymer molecular chain determined by a $^{13}C$ NMR spectra. Such propylene based copolymers are further described in details in the U.S. Pat. Nos. 6,960,635 and 6,525,157. Such propylene/alpha-olefin copolymers are commercially available from The Dow Chemical Company, under the trade name VERSIFY™, or from ExxonMobil Chemical Company, under the trade name VISTAMAXX™.

In another embodiment, the thermoplastic polymer may be ethylene vinyl acetate (EVA) based polymers. In other embodiments, the thermoplastic polymer may be ethylene-methyl acrylate (EMA) based polymers. In yet another embodiment, the ethylene-alpha olefin copolymer may be ethylene-butene, ethylene-hexene, or ethylene-octene copolymers or interpolymers. In yet another embodiment, the propylene-alpha olefin copolymer may be a propylene-ethylene or a propylene-ethylene-butene copolymer or interpolymer.

In certain embodiments, the thermoplastic polymer may be a propylene-ethylene copolymer or interpolymer having an ethylene content of between 5 and 20 percent by weight and a melt flow rate (230° C. with 2.16 kg weight) from 0.5 to 300 g/10 min. In other embodiments, the propylene-ethylene copolymer or interpolymer may have an ethylene content of between 9 and 12 percent by weight and a melt flow rate (230° C. with 2.16 kg weight) from 1 to 100 g/10 min.

In some embodiments, the thermoplastic polymer has a crystallinity of less than 50 percent. In preferred embodiments, the crystallinity of the thermoplastic polymer may be from 5 to 35 percent. In more preferred embodiments, the crystallinity may range from 7 to 20 percent.

In certain other embodiments, the thermoplastic polymer is a semi-crystalline polymer and may have a melting point of less than 110° C. In preferred embodiments, the melting point may be from 25 to 100° C. In more preferred embodiments, the melting point may be between 40 and 85° C.

In other selected embodiments, olefin block copolymers, for example, ethylene multi-block copolymer, such as those described in U.S. Pat. No. 7,608,668 may be used as the thermoplastic polymer.

In certain embodiments, the thermoplastic polymer comprises a polar polymer, having a polar group as either a comonomer or grafted monomer. In exemplary embodiments, the thermoplastic polymer comprises one or more polar polyolefins, having a polar group as either a comonomer or grafted monomer. Exemplary polar polyolefins include ethylene-acrylic acid (EAA) and ethylene-methacrylic acid copolymers, such as those available under the trademarks PRIMACOR™, commercially available from The Dow Chemical Company, NUCREL™, commercially available from DuPont, and ESCOR™, commercially available from ExxonMobil Chemical Company and described in U.S. Pat. Nos. 4,599,392, 4,988,781, and 5,938,437. Other exemplary thermoplastic polymers include ethylene ethyl acrylate (EEA) copolymer, ethylene methyl methacrylate (EMMA), and ethylene butyl acrylate (EBA).

Preferably, the thermoplastic polymer is selected from homopolymers or copolymers of alpha-olefins such as ethylene, propylene, 1-butene, etc., or their combination; recycled homopolymers or copolymers of alpha-olefins; functionalized homopolymers or copolymers of alpha-olefins; acrylic, styrene, PU, epoxy, VAE and polyester or their combination.

More preferably, the thermoplastic polymer is homopolymers or copolymers of alpha-olefins such as ethylene, propylene, 1-butene, etc., or their combination; recycled homopolymers or copolymers of alpha-olefins.

Most preferably, the thermoplastic polymer is homopolymers or copolymers of alpha-olefins such as ethylene, propylene, 1-butene, etc., or their combination.

The surface tension difference of the pigment and the thermoplastic polymer is less than 40 mN/m, preferably less than 35 mN/m, and more preferably less than 30 mN/m.

The first dispersant may preferably be an external dispersant, and is used in an amount of from 1 wt. % to 50 wt. %, preferably from 3 wt. % to 45 wt. %, and more preferably from 6 wt. % to 40 wt. % based on the total weight of the hiding composie. In selected embodiments, the first dispersant may be a polymer, or mixtures thereof. In certain embodiments, the first dispersant can be a polar polymer, having a polar group as either a co-monomer or grafted monomer. In exemplary embodiments, the first dispersant comprises one or more polar polyolefins, having a polar group as either a co-monomer or grafted monomer. Exemplary polymeric dispersants include ethylene-acrylic acid (EAA) and ethylene-methacrylic acid copolymers, such as those available under the trademarks PRIMACOR™, commercially available from The Dow Chemical Company, NUCREL™, commercially available from DuPont, and ESCOR™, commercially available from ExxonMobil Chemical Company and described in U.S. Pat. Nos. 4,599,392, 4,988,781, and 5,938,437. Other exemplary polymeric dispersants include ethylene ethyl acrylate (EEA) copolymer, ethylene methyl methacrylate (EMMA), and ethylene butyl acrylate (EBA). Other ethylene-carboxylic acid copolymer may also be used. Other dispersants that may be used include long chain fatty acids, fatty acid salts, or fatty acid alkyl esters having from 12 to 60 carbon atoms. In other embodiments, the long chain fatty acid or fatty acid salt may have from 12 to 40 carbon atoms.

The first dispersant may be partially or fully neutralized with a neutralizing agent. In certain embodiments, neutralization of the dispersant, such as a long chain fatty acid or EAA, may be from 25 to 200 percent on a molar basis; or in the alternative, it may be from 50 to 110 percent on a molar basis. For example, for EAA, the neutralizing agent may be a base, such as ammonium hydroxide or potassium hydroxide. Other neutralizing agents can include lithium hydroxide or sodium hydroxide, for example. In another alternative, the neutralizing agent may, for example, be a carbonate. In another alternative, the neutralizing agent may, for example, be any amine such as monoethanolamine, or 2-amino-2-methyl-1-propanol (AMP). Amines useful in embodiments disclosed herein may include monoethanolamine, diethanolamine, triethanolamine, and TRIS AMINO™ (each available from Angus), NEUTROL™ TE (available from BASF), as well as triisopropanolamine, diisopropanolamine, and N,N-dimethylethanolamine (each available from The Dow Chemical Company, Midland, Mich.). Other useful amines may include ammonia, monomethylamine, dimethylamine, trimethylamine, monoethylamine, diethylamine, triethylamine, mono-n-propylamine, dimethyl-n propylamine, N-methanol amine, N-aminoethylethanolamine, N-methyldiethanolamine, monoisopropanolamine, N,N-dimethyl propanolamine, 2-amino-2-methyl-1-propanol, tris(hydroxymethyl)-aminomethane, N,N,N'N'-tetrakis(2-hydroxylpropyl)ethylenediamine. In some embodiments, mixtures of amines or mixtures of amines and dispersants may be used. Those having ordinary skill in the art will appreciate that the selection of an appropriate neutralizing agent depends on the specific composition formulated, and that such a choice is within the knowledge of those of ordinary skill in the art.

Preferably, the first dispersant is an ethylene-acrylic acid copolymer, or a behenic acid.

The second dispersant is a low-pH-stable dispersant, and is used in an amount of from 1% to 10%, preferably from 2% to 6%, and more preferably from 3% to 4%, by weight based on the total weight of the hiding composite. The second dispersant preferably has a formula (I) being:

(I)

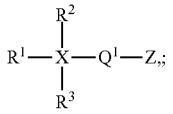

wherein X is N cation or P cation; Z is $—CO_2$ anion, $—SO_3$ anion, $—O—P(O)_2OH$ anion, $—O—P(O)_3$ dianion, or $—O—S(O)_3$ anion; Each of $R^2$ and $R^3$ independently is $(C_1-C_{10})$alkyl or $(C_2-C_{10})$alkenyl; $R^1$ is $(C_6-C_{30})$alkyl, $(C_6-C_{30})$alkenyl, or $R^4—C(O)N(H)-Q^2-$; Each of $Q^1$ and $Q^2$ independently is $(C_1-C_{10})$alkylene; and $R^4$ is $(C_6-C_{30})$alkyl. The compound of formula (I) is overall formally neutral.

In some embodiments, the second dispersant is the compound of formula (I) wherein X is N cation. In other embodiments X is P cation.

In some embodiments the second dispersant is the compound of formula (I) selected from the group consisting of:

N-(3-erucylamino)propyl-N,N-dimethylglycine;

N-(3-coco-derived acylamino)propyl-N,N-dimethylglycine;

N-(3-laurylamino)propyl-N,N-dimethylglycine;

N-(3-myristylamino)propyl-N,N-dimethylglycine;

N-(3-cetylamino)propyl-N,N-dimethylglycine; and N-(3-cocoamidopropyl)-N,N-dimethyl-N-(2-hydroxy-3-sulfopropyl)ammonium betaine.

The N-(3-erucylamiodo)propyl-N,N-dimethylglycine, N-(3-coco-derived acylamino)propyl-N,N-dimethylglycine, and N-(3-cocoamidopropyl)-N,N-dimethyl-N-(2-hydroxy-3-sulfopropyl)ammonium betaine respectively have the structures of formulas (1), (Ia), and (Ib):

(1)

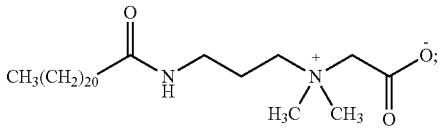

(Ia)

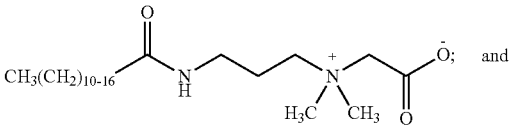

(Ib)

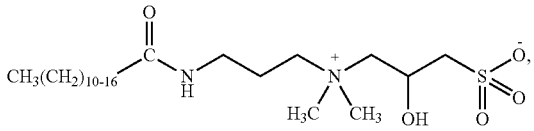

and preferably the $CH_3CH_{10}$—C(O)-containing member thereof.

The N-(3-laurylamino)propyl-N,N-dimethylglycine; N-(3-myristylamino)propyl-N,N-dimethylglycine; and N-(3-cetylamino)propyl-N,N-dimethylglycine; respectively have the structures of formula (2) to (4):

(2)

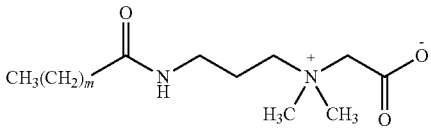

m is 12; and (4) m is 14.

In some embodiments the dispersant is the compound of formula (I) selected from the group consisting of: N-dodecyl-N,N-dimethylglycine; N-tetradecyl-N,N-dimethylglycine; and N-hexadecyl-N,N-dimethylglycine, which respectively have the structures of formulas (5) to (7):

(5)

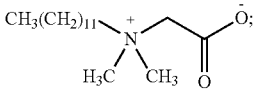

(6)

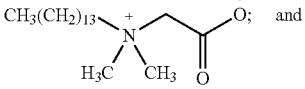

(7)

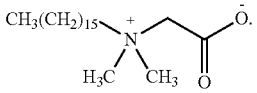

Water content of the dispersion is from 35 to 75 by volume based on the total volume of the dispersion. In particular embodiments, the water content may be in the range of from 35 to 70, or in the alternative from 35 to 65, or in the alternative from 45 to 55 percent by volume, based on the total volume of the dispersion. Water content of the dispersion may preferably be controlled so that the solids content (thermoplastic polymer, dispersants, and pigment particles) is between 1 percent to 74 percent by volume. In particular embodiments, the solids range may be from 10 percent to 70 percent by volume. In other particular embodiments, the solids range is from 20 percent to 60 percent by volume. In certain other embodiments, the solids range is from 30 percent to 55 percent by volume.

The paper composition of the present invention is made of the hiding composite dispersion and a paper pulp. The paper composition of the present invention comprises based on the total weight of the composition, from 15 wt. % to 70 wt. %, preferably from 20 wt. % to 65 wt. %, and more preferably from 25 wt. % to 60 wt. % of the hiding composite; and from 30 wt. % to 85 wt. %, preferably from 35 wt. % to 80 wt. %, and more preferably from 40 wt. % to 75 wt. % of a paper pulp.

Softwood pulp (long-fiber pulp) or hardwood pulp (short-fiber pulp) or a combination thereof may be used as the paper pulp for producing the paper composition.

Other additives including retention agent, such as quaternary ammonium salt, could also be used in making the paper slurries. These additives and their use amounts are not critical and are well-known in the art of paper making.

EXAMPLES

I. Raw Materials

| Function | Name | Chemical structure | Supplier |
|---|---|---|---|
| Thermo-plastic polymer | INFUSE ™ 9500 polymer | Ethylene-propylene block copolymer | Dow |
| Pigment | TI-PURE ™ R105 $TiO_2$ | Titanium Oxide-compounding grade (Hydrophobic grades) | DuPont |
| | TI-PURE ™ R706 $TiO_2$ | Titanium Oxide-coating grade (Hydrophilic grades) | DuPont |
| Dispersant | PRIMACOR ™ 5980i polymer | Ethylene-acrylic acid copolymer | Dow |
| Caustic | Potassium hydroxide | 45 wt. % KOH | Shanghai Chemicals and Reagents Company (SCRC) |
| Paper Pulp | Soft/hard wood chemical pulp bleaching | Soft/hard wood chemical pulp bleaching | Jiangnan University |

II. Preparation and Methods

Hiding composite dispersions 1 to 3 were prepared according to the following process: TI-PURE™ R105 $TiO_2$ and INFUSE™ 9500 polymer were melt-kneaded within a twin-screw extruder to form an uniform solid composite in the form of pellets; melt-kneading the uniform solid composite, PRIMACOR™ 5980i polymer, and an initial aqueous stream (IA) of water in the same twin-screw extruder to form a high internal phase emulsion phase; and melt-kneading the high internal phase emulsion phase with a dilution aqueous stream of water in the same twin-screw extruder.

Preparation of Hiding Composite Dispersion 1

Aqueous $TiO_2$ dispersion of ethylene/propylene olefin block copolymer stabilized with ethylene acrylic acid copolymer and neutralized with potassium hydroxide was prepared according to the below procedure. 25,000 parts TI-PURE™ R105 $TiO_2$ powder, and 10,000 parts INFUSE™ 9500 ethylene/propylene olefin block copolymer were fed into a barrel of a twin-screw extruder (ZSK 26 MEGAcompounder PLUS (McPLUS), Coperion Corp., Ramsey, N.J., USA) together with 9,000 parts PRIMACOR™ 5980i ethylene acrylic acid copolymer and melt-kneaded at about 160° C. to give a molten powder blend. Thereafter, a solution of 32 parts potassium hydroxide (KOH) dissolved in 398 parts deionized water was fed into the molten powder blend in the barrel of the twin-screw extruder under pressure and at a temperature of about 180° C. As the mixture of the molten powder blend and the aqueous KOH passing down the barrel of the extruder, deionized water was fed until a dispersion having about 45 wt % solids is produced. The dispersion was cooled to below 90° C. before being extruded from the extruder and then was collected in a container to make the hiding composite dispersion 1.

Hiding composite dispersion 1 has a 44.9 wt % solids content. The solids comprise 43.2 wt % of polymer (including ethylene/propylene olefin block copolymer and ethylene acrylic acid copolymer) and 56.8 wt % of $TiO_2$. The dispersion has a polydispersity index of 0.431 and a mean particle size volume (i.e., average particle size based on volume) of 0.927 micron and a particle size range of from about 0.4 micron to 1.5 micron.

Preparation of Hiding Composite Dispersion 2

Aqueous $TiO_2$ dispersion of ethylene/propylene olefin block copolymer stabilized with ethylene acrylic acid copolymer and neutralized with potassium hydroxide was prepared according to the below procedure.

20,000 parts TI-PURE™ R105 $TiO_2$ powder, and 10,000 parts INFUSE™ 9500 ethylene/propylene olefin block copolymer were fed into a barrel of a twin-screw extruder (ZSK 26 MEGAcompounder PLUS (McPLUS), Coperion Corp., Ramsey, N.J., USA) together with 10,000 parts PRIMACOR™ 5980i ethylene acrylic acid copolymer and melt-kneaded at about 165° C. to give a molten powder blend. Thereafter, a solution of 36 parts potassium hydroxide (KOH) dissolved in 250 parts deionized water was fed into the molten powder blend in the barrel of the twin-screw extruder under pressure and at a temperature of about 180° C. As the mixture of the molten powder blend and the aqueous KOH passing down the barrel of the extruder, deionized water was fed until a dispersion having about 40 wt % to 60 wt % solids was produced. The dispersion was cooled to below 90° C. before being extruded from the extruder and then was collected in a container to make the hiding composite dispersion 2.

Hiding composite dispersion 2 has a 45.1 wt % solids content. The solids comprise 50 wt % of polymer (including ethylene/propylene olefin block copolymer and ethylene acrylic acid copolymer) and 50 wt % of $TiO_2$. The dispersion has a polydispersity index of 0.525 and a mean particle size volume (i.e., average particle size based on volume) of 0.847 micron and a particle size range of from about 0.4 micron to 1.5 micron.

Preparation of Hiding Composite Dispersion 3

Aqueous $TiO_2$ dispersion of ethylene/propylene olefin block copolymer stabilized with ethylene acrylic acid copolymer and neutralized with potassium hydroxide was prepared according to the below procedure.

12,600 parts DuPont TI-PURE™ R105 $TiO_2$ powder, and 10,000 parts INFUSE™ 9500 ethylene/propylene olefin block copolymer were fed into a barrel of a twin-screw extruder (ZSK 26 MEGAcompounder PLUS (McPLUS), Coperion Corp., Ramsey, N.J., USA) together with 9,000 parts PRIMACOR™ 5980i ethylene acrylic acid copolymer and melt-kneaded at about 150° C. to give a molten powder blend. Thereafter, a solution of 32 parts potassium hydroxide (KOH) dissolved in 286 parts deionized water was fed into the molten powder blend in the barrel of the twin-screw extruder under pressure and at a temperature of about 180° C. As the mixture of the molten powder blend and the aqueous KOH passing down the barrel of the extruder, deionized water was fed until a dispersion having about 45 wt % solids was produced. The dispersion was cooled to below 90° C. before being extruded from the extruder and then was collected in a container to make the hiding composite dispersion 3.

Hiding composite dispersion 3 has a 45.3 wt % solids content. The solids comprise 60.1 wt % of polymer (including ethylene/propylene olefin block copolymer and ethylene acrylic acid copolymer) and 39.9 wt % of $TiO_2$. The dispersion has a polydispersity index of 0.485 and a mean particle size volume (i.e., average particle size based on volume) of 0.894 micron and a particle size range of from about 0.4 micron to 1.5 micron.

Table 1 shows the detailed components of the hiding composite dispersions 1 to 3.

TABLE 1

| Hiding composite dispersion | Polymer (solid/solid) | $TiO_2$ (solid/solid) | Solids |
|---|---|---|---|
| 1 | 43.2 wt. % | 56.8 wt. % | 44.9 wt. % |
| 2 | 50 wt. % | 50 wt. % | 45.1 wt. % |
| 3 | 60.1 | 39.9 wt. % | 45.3 wt. % |

Paper Pulp Preparation

Pulp formulation comprises 15 wt. % of Acerola wood pulp (net weight; Beating Freeness is 31.5° SR) and 85 wt. % of Alder wood pulp (net weight; Beating Freeness is 35.5° SR). Mixed pulp beating freeness is 34.0° SR.

Inventive Examples

Paper Composition (Base Paper) 1

1.5072 g dry paper pulp and required water were added into a homogenizer container, and mixed for 2 min by a stirrer at 2000 rmp. 2.8 g hiding composite dispersion 1 (44.9% solid content) was added into the container, and mixed for another 3 minutes. The well mixed mixture was transferred into a container and filtered with a screen at the bottom of the container. The solids stayed on the screen as a solid sheet. The solid sheet was transferred to a vacuum drier and residual water was removed to get a base paper. The base paper was kept in a Constant Temperature Room (CTR 25° C., 50% RH) for one night to reach the equilibrium of water. The ash content of the base paper was tested according to GB/T 742-2008. The ash content was used to characterize the $TiO_2$ residue in the final base paper, which provides hiding effect to the base paper. Five pieces of base paper were made for each example and the average number was deemed as the final result. The final ash content of the base paper was 15.7 wt. % and the corresponding opacity of the base paper was 97.43%.

Paper Composition 2

1.0000 g dry paper pulp and 6.0 g hiding composite dispersion 2 (45.1% solid content) were made into a base paper according to the procedure described in the preparation of the paper composition 1. The final ash content of the base paper was 21.44 wt. % and the corresponding opacity of the base paper was 97.82%.

Paper Composition 3

1.2000 g dry paper pulp and 4.2 g hiding composition dispersion 2 (45.1% solid content) were made into a base paper according to the procedure described in the preparation of the paper composition 1. The final ash content of the base paper was 26.27 wt. % and the corresponding opacity of the base paper was 98.61%.

Paper Composition 4

1.7584 g dry paper pulp and 2.8 g hiding composition dispersion 2 (45.1% solid content) were made into a base paper according to the procedure described in the preparation of the paper composition 1. The final ash content of the base paper was 13.82 wt. % and the corresponding opacity of the base paper was 97.64%.

Paper Composition 5

1.7584 g dry paper pulp and 2.3 g hiding composition dispersion 3 (45.3% solid content) were made into a base paper according to the procedure described in the preparation of the paper composition 1. The final ash content of the base paper was 9.920 wt. % and the corresponding opacity of the base paper was 98.57%.

Comparative Examples

Comparative Paper Composition C1

1.7584 g dry paper pulp and 4.2 g DuPont TI-PURE™ R-706 (50% solid content) were made into a base paper according to the procedure described in the preparation of the paper composition 1. The final ash content of the base paper was 33.69 wt. % and the corresponding opacity of the base paper was 97.54%.

Comparative Paper Composition C2

1.5072 g dry paper pulp and 7.0 g DuPont TI-PURE™ R-706 (50% solid content) were made into a base paper according to the procedure described in the preparation of the paper composition 1. The final ash content of the base paper was 44.00 wt. % and the corresponding opacity of the base paper was 97.88%.

III. Results

TABLE 2

| Paper Composition | Paper Pulp (g) | Hiding composite/ $TiO_2$ dispersion (g) | Ash (%) | Paper Pulp/ $TiO_2$/polymer (%; Solids) | Opacity (CR %) |
|---|---|---|---|---|---|
| 1 | 1.5072 | 2.8 (44.9% Solids) | 15.70 | 72.4/15.7/11.9 | 97.43 |
| 2 | 1.0000 | 6.0 (45.1% Solids) | 21.44 | 57.2/21.4/21.4 | 97.82 |
| 3 | 1.2000 | 4.2 (45.1% Solids) | 26.27 | 47.4/26.3/26.3 | 98.61 |
| 4 | 1.7584 | 2.8 (45.1% Solids) | 13.82 | 72.4/13.8/13.8 | 97.64 |
| 5 | 1.7584 | 2.3 (45.3% Solids) | 9.92 | 75.2/9.9/14.9 | 98.57 |
| C1 | 1.7584 | 4.2 (50% Solids) | 33.69 | 66.3/33.7/0 | 97.54 |
| C2 | 1.5072 | 7.0 (50% Solids) | 44.00 | 56.0/44.0/0 | 97.88 |

Table 2 shows the $TiO_2$ loading differences in paper compositions 1 to 5 and C1 to C2 for similar opacity requirements. Satisfactory opacity for base paper should be higher than 97.40%. The higher the opacity, the more qualified the base paper. Paper compositions 1 to 5 comprise $TiO_2$ loadings of from 9.9 to 26.3 wt. % based on the total weight of the paper composition. While, comparative paper compositions C1 to C2 comprise $TiO_2$ loadings of from 33.7 wt. % to 44.0 wt. %. To obtain similar opacity for paper composition, melt-kneading selected $TiO_2$ with selected polymer significantly decreased the usage of $TiO_2$.

What is claimed is:

1. A paper composition comprising, based on the total weight of the paper composition, a) from 15 wt. % to 70 wt. % a hiding composite, wherein the hiding composite comprises based on the total weight of the hiding composite, from 30 wt. % to 75 wt. % pigment particles and from 25 wt. % to 70 wt. % a thermoplastic polymer, wherein the pigment particles are hydrophobically treated by silanization, the surface tension of the pigment particles is from 0.1 to 50 mN/m, and the surface tension difference between the pigment particles and the thermoplastic polymer is less than 40 mN/m; and b) from 30 wt. % to 85 wt. % a paper pulp.

2. The paper composition according to claim 1 wherein the surface tension of the pigment particles is from 0.5 to 40 mN/m and the surface tension difference between the pigment particles and the thermoplastic polymer is less than 35 mN/m.

3. The paper composition according to claim 1 wherein the pigment particles are selected from the group consisting of barium sulfate, lithopone, zinc phosphate, $TiO_2$, ZnO, and mixture thereof.

4. The paper composition according to claim 3 wherein the pigment particles comprise $TiO_2$.

5. The paper composition according to claim 1 wherein the thermoplastic polymer is selected from the group consisting of homopolymers or copolymers of an alpha-olefin, polyolefin, styrene, polyvinyl, polyester, polycarbonate, vinyl ester, resin, and mixture thereof.

6. The paper composition according to claim 1, wherein the hiding composite is prepared by:

(i) pre-mixing the pigment particles and the thermoplastic polymer to form a pre-mixture;

(ii) melt-kneading the pre-mixture with, based on the total weight of the hiding composite, from 1 wt. % to 50 wt. % of a first stabilizing agent; and from 1 wt. % to 10 wt. % of a low pH stable second stabilizing agent.

7. The paper composition according to claim 1, wherein the pigment particles comprise $TiO_2$, and the thermoplastic polymer comprises ethylene-propylene block copolymer.

8. A process of preparing a paper composition comprising:

a) preparing a hiding composite dispersion by i) pre-mixing, based on the total weight of a hiding composite, from 30 wt. % to 75 wt. % of pigment particles; and from 25 wt. % to 70 wt. % of a thermoplastic polymer to form a pre-mixture;

ii) melt-kneading the pre-mixture with, based on the total weight of the hiding composite, from 1 wt. % to 50 wt. % of a first stabilizing agent; and from 1 wt. % to 10 wt. % of a low pH stable second stabilizing agent;

wherein the pigment particles are hydrophobically treated by silanization, the surface tension of the pigment particles is from 0.1 to 50 mN/m, and the surface tension difference between the pigment particles and the thermoplastic polymer is less than 40 mN/m; and b) mixing the hiding composite with a paper pulp and water;

wherein the hiding composite is from 15 wt. % to 70 wt. %, and the paper pulp is from 30 wt. % to 85 wt. % based on the total weight of the paper composition.

9. The process according to claim 8 wherein the surface tension of the pigment particles is from 0.5 to 40 mN/m and the surface tension difference between the pigment particles and the thermoplastic polymer is less than 35 mN/m.

10. The process according to claim 8 wherein the pigment particles are selected from the group consisting of barium sulfate, lithopone, zinc phosphate, $TiO_2$, ZnO, and mixture thereof.

11. The process according to claim 10 wherein the pigment particles comprise $TiO_2$.

12. The process according to claim 8 wherein the thermoplastic polymer is selected from the group consisting of homopolymers or copolymers of an alpha-olefin, polyolefin, styrene, polyvinyl, polyester, polycarbonate, vinyl ester, resin, and mixture thereof.

13. The process according to claim 8, wherein the pigment particles comprise $TiO_2$, and the thermoplastic polymer comprises ethylene-propylene block copolymer.

* * * * *